US007286097B1

(12) United States Patent
Van Buren et al.

(10) Patent No.: US 7,286,097 B1
(45) Date of Patent: Oct. 23, 2007

(54) YAGI ANTENNA WITH BALANCING TAB

(75) Inventors: Alan Van Buren, Cedar City, UT (US); Richard M. Kline, Cedar City, UT (US)

(73) Assignee: Wilson Electronics, Inc., Saint George, UT (US)

( * ) Notice: Subject to any disclaimer, the term of this patent is extended or adjusted under 35 U.S.C. 154(b) by 28 days.

(21) Appl. No.: 11/449,294

(22) Filed: Jun. 8, 2006

(51) Int. Cl.

| | |
|---|---|
| ***H01Q 21/00*** | (2006.01) |
| ***H01Q 11/04*** | (2006.01) |
| ***H01Q 21/12*** | (2006.01) |
| ***H01Q 19/00*** | (2006.01) |
| ***H01Q 19/30*** | (2006.01) |

(52) U.S. Cl. ..... 343/811; 343/810; 343/812; 343/813; 343/814; 343/815; 343/816; 343/817; 343/818; 343/819

(58) Field of Classification Search ..... 343/810, 343/811, 812, 813, 814, 815, 816, 817, 818, 343/819

See application file for complete search history.

(56) References Cited

U.S. PATENT DOCUMENTS 4,218,686 A * 8/1980 Blonder ..... 343/819
5,898,410 A * 4/1999 DeMarre ..... 343/792.5
6,326,922 B1 * 12/2001 Hegendoerfer ..... 343/700 MS
6,483,476 B2 * 11/2002 Cox ..... 343/815
2006/0066441 A1 * 3/2006 Knadle et al. ..... 340/10.1

* cited by examiner

*Primary Examiner*—Hoang V. Nguyen
*Assistant Examiner*—Robert Karacsony
(74) *Attorney, Agent, or Firm*—Leon D. Rosen

(57) ABSTRACT

An antenna minimizes radiation from the outer conductor (44) of a coaxial cable (40) that is coupled to the antenna by providing a balancing tab (90) that lies near the connection (72) of the cable outer conductor (44) to the antenna. One antenna includes a Yagi structure (12) constructed of a plate of metal that forms a long boom (20) and a plurality of directors (28) extending laterally across the boom, with an electrical coupling loop mounted at a rear region of the Yagi structure. The coupling loop includes a folded dipole in the form of a metal coupling plate that forms a loop (54) with a gap (70), the loop having a laterally elongated front loop end (60). The Yagi structure is formed with a balancing tab (90) that lies forward of the loop, that has a lateral length (D) less than half that of one of the directors, and that extends from only one side (22) of the boom which is the side to which the outer coax conductor (44) is connected to the loop. The metal coupling plate lies facewise adjacent to a face (24) of the Yagi plate, with a dielectric spacer (76) between them.

13 Claims, 2 Drawing Sheets

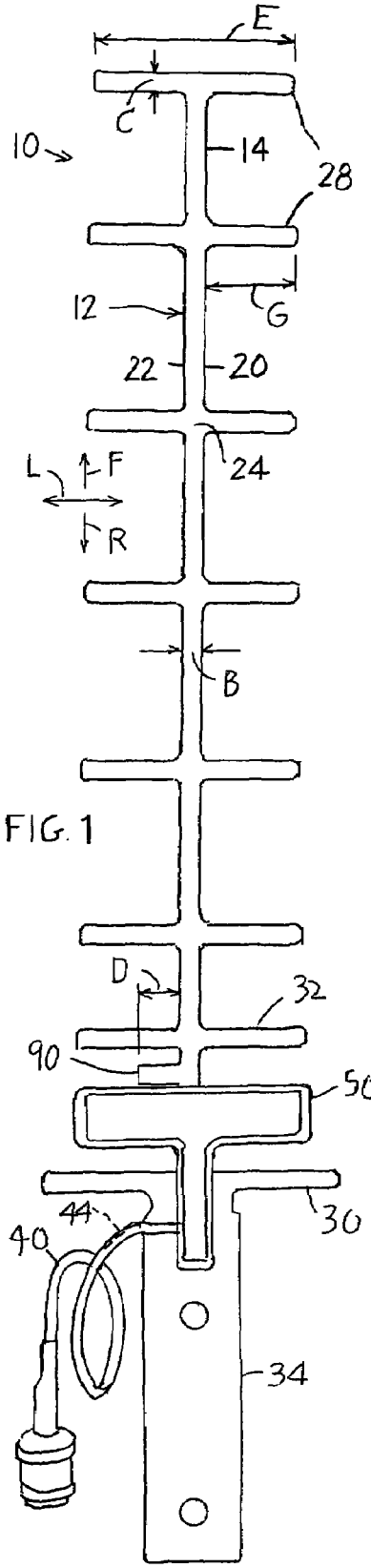
FIG. 1
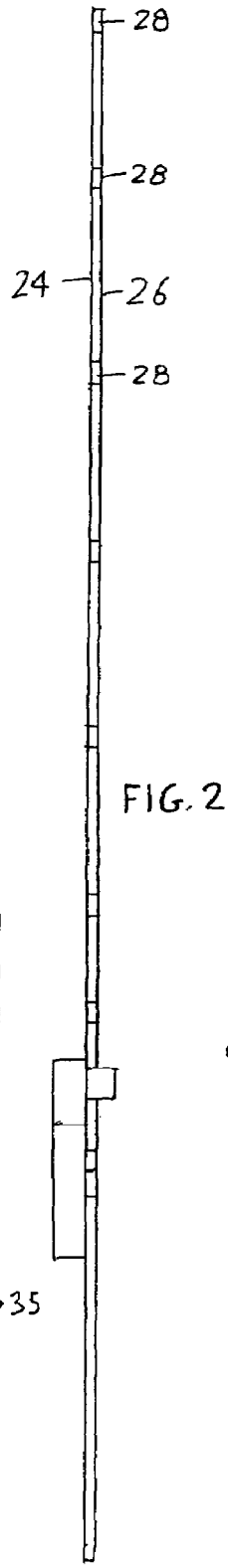
FIG. 2
FIG. 3
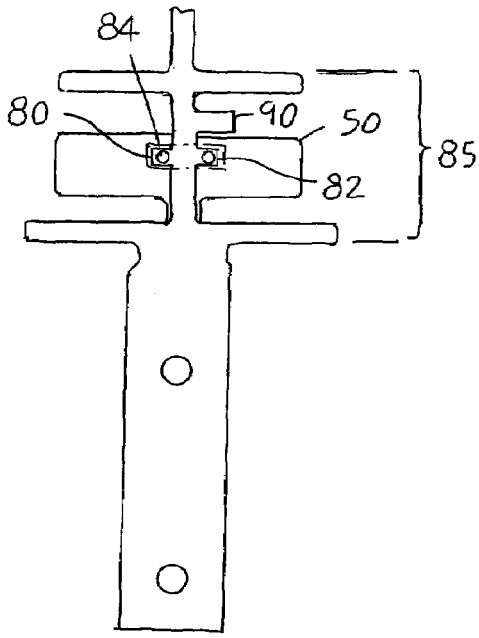

YAGI ANTENNA WITH BALANCING TAB

BACKGROUND OF THE INVENTION

A transmission line such as a coaxial cable, which is connected to an antenna such as a Yagi antenna, may radiate energy that seriously degrades both the gain and radiation pattern of the antenna. Ideally, equal and opposite currents flow from the coaxial cable into the terminals of a balanced antenna. However, in practice, energy radiates from the outer conductor (the shield) of the coaxial cable. A common technique used to minimize such radiation is to connect a balun (which stands for "balanced to unbalanced") in the circuit which forces the coaxial cable to feed equal and opposite currents into the antenna. A balun is basically a wire wound transformer or a specially connected distributed transmission line, and results in mechanical and electrical disadvantages. A mechanical disadvantage is that the balun must be protected from moisture and from exposure to the sun, and the balun can be a bulky part that produces a large bulge in the antenna. An electrical disadvantage is that the balun introduces losses, thereby reducing antenna gain and therefore its efficiency. The balun also increases manufacturing cost. A change to an antenna which minimized radiation from the transmission line such as a coaxial cable, in a simple and low cost manner which avoided the disadvantages of a balun, would be of value.

SUMMARY OF THE INVENTION

In accordance with one embodiment of the present invention, an antenna, and in particular a Yagi antenna, is provided which minimizes radiation from a transmission line such as a coaxial cable that carries signals to or from the antenna, in a manner that avoids the need for a balun, to thereby reduce the cost of the antenna and make it more compact and efficient. A Yagi antenna is provided of the type that has a flat Yagi structure, with a boom that extends in front and rear directions and with a plurality of directors that extend laterally across the boom. The antenna is improved by providing a balancing tab that extends laterally from one side of the boom. A coaxial cable is coupled to the Yagi structure by an electrical coupling that includes a folded dipole formed by a metal plate. The metal plate is mounted on a dielectric separator that lies facewise adjacent to a rear portion of the Yagi structure. The metal plate forms a loop having laterally long front and rear loop parts, the rear loop part having a gap. The inner and outer coax conductors are connected to the rear loop part at opposite sides of the gap. The balancing tab lies a short distance forward of the front loop part, on the same side of the boom as the side of the gap to which the coax cable outer conductor is connected.

The metal plate that forms the loop, and the separator, can be mounted on the Yagi structure by a pair of simple screws, and the metal plate that forms a loop projects only slightly from the plane of the Yagi elements. This results in a simple and easily constructed antenna that is compact.

The novel features of the invention are set forth with particularity in the appended claims. The invention will be best understood from the following description when read in conjunction with the accompanying drawings.

BRIEF DESCRIPTION OF THE DRAWINGS

FIG. 1 is a top view of an antenna of the present invention.

FIG. 2 is a right side view of the antenna of FIG. 1.

FIG. 3 is a partial bottom view of the antenna of FIG. 1.

DESCRIPTION OF THE PREFERRED EMBODIMENTS

Figure 4:
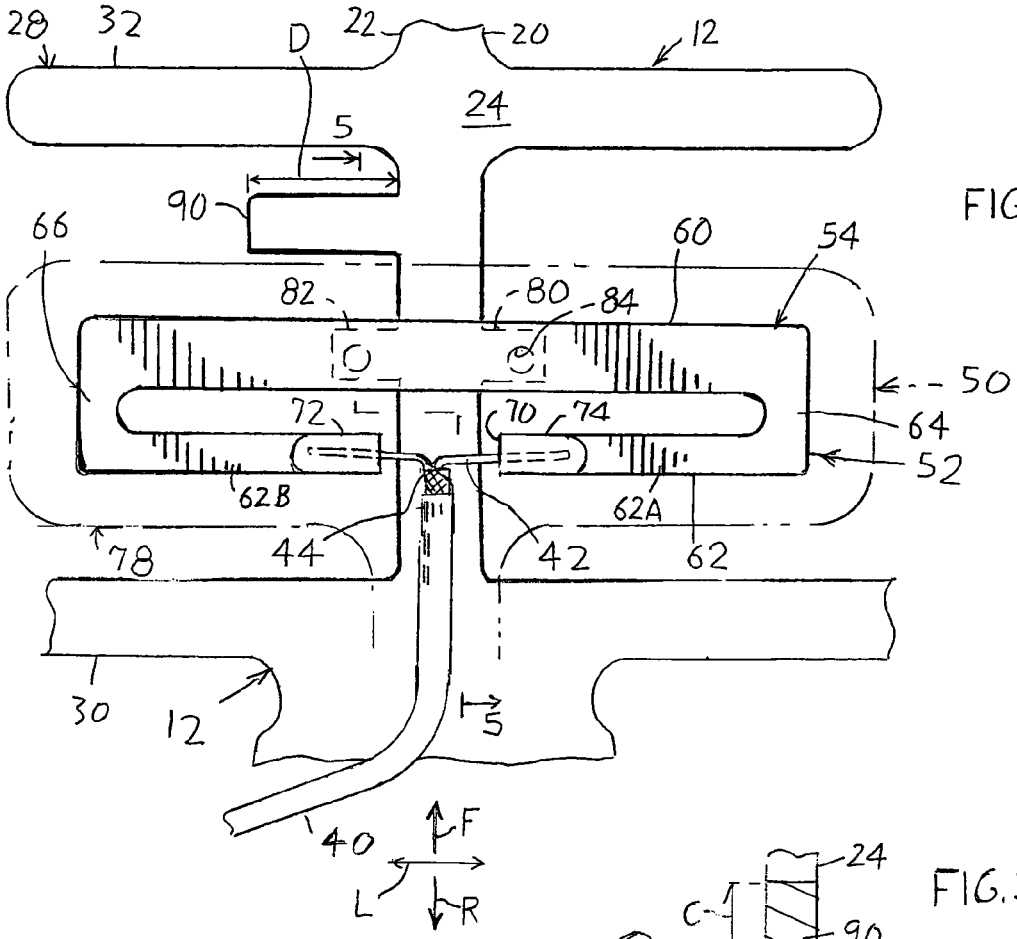
FIG. 4 is a partial top view of the antenna of FIG. 1, with the dielectric frame shown only in phantom lines.

FIGS. 1-3 illustrate a Yagi antenna 10 (named after the inventor, Yagi Hidetsuga) which is a highly directional antenna for electromagnetic radiation, with the particular antenna illustrated having been constructed for use in the 1900 MHz cell phone frequency band. The Yagi antenna includes an electrically conductive Yagi structure 12 having an elongated boom 14 that is elongated in front and rear directions F, R and that has laterally L opposite boom sides 20, 22 and opposite boom faces 24, 26. The Yagi structure also has a plurality of directors 28 that are each elongated in the lateral directions L and that each extends across the boom and that each has parts of equal length on laterally opposite sides of the boom. The Yagi structure also includes a reflector 30 that lies rearward of the directors 28 and that generally has a greater lateral length than the directors. The antenna radiates power in the forward direction F and receives radiation moving in the rearward direction R.

The directors 28 includes a rearmost director 32, which lies forward of the reflector 30, and that is referred to as the first director. Progressively more forward directors are referred to as the second, third, etc. directors and are of equal lateral lengths, or are of progressively smaller lengths. A rear end part 34 of the Yagi antenna, which lies in a rear portion 35 of the Yagi structure, is a supported region where the antenna is normally supported. The entire Yagi structure 12 is formed from a plate of conductive material, such as aluminum.

As shown in FIG. 4, high frequency signals are carried to and from the Yagi structure by a transmission line such as coaxial cable 40, that has inner and outer conductors 42, 44. The signals are coupled between the cable and Yagi structure by a coupling assembly 50 that includes a folded dipole 52 in the form of a loop 54. The loop has front and rear loop parts 60, 62 and has loop sides 64, 66 that connect together each pair of adjacent ends of the front and rear loop parts. The rear loop part has a gap 70, and the coaxial conductor inner and outer conductors are connected to opposite gap sides 72, 74 of the rear loop part, with solder connections being shown.

Figure 5:
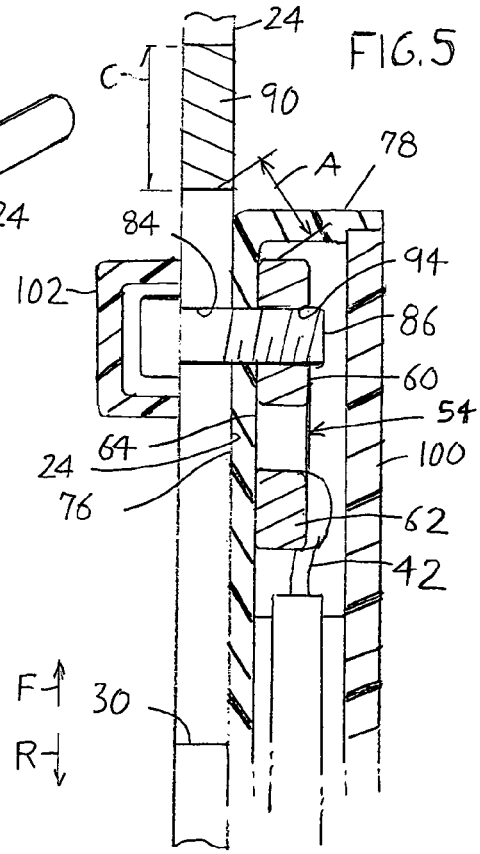
FIG. 5 is a sectional view of a portion of the antenna as taken on line 5-5 of FIG. 4.

As shown in FIG. 5, the front and rear loop parts 60, 62 each lie adjacent to a face 24 of the Yagi structure. The loop 54 is formed of a metal plate with one face 64 of the metal plate lying facewise (their adjacent faces are parallel and adjacent, or close) to the face 24 of the Yagi structure, with an insulative, or dielectric spacer or spacer part 76 lying between them. The dielectric spacer 76 is part of a dielectric housing 78 that surrounds the electrical coupling, and together the housing and coupling form the coupling assembly 50. As shown in FIG. 4, the Yagi boom is formed with at least one mounting ear, and preferably with a pair of mounting ears 80, 82. The mounting ears have holes 84 that receive fasteners 86 (FIG. 5) that project though the Yagi boom ears, though the spacer part 76 and though holes in the loop. The metal plate that forms the loop has about the same thickness as the Yagi structure and of the spacer part 76, so the thickness of the antenna with the electrical coupling is of the same order of magnitude as the Yagi structure alone. As a result, the Yagi antenna is compact. The metal plate that forms the loop 54 lies in a mount region 85 (FIG. 3) that lies between the reflector 30 and first director 32.

Despite the attempt at the balanced transfer of signals by the electrical coupling 50 between the coaxial cable and the Yagi structure, currents flow in a manner that results in radiation from the outer conductor 44 of the coaxial cable. Previously, such imbalance was compensated for by the use of a balun (short for balanced to unbalanced) which is in the form of a wound transformer, or by a specially connected transmission line. Such a balun has considerable bulk, and results in a less compact, less efficient and more expensive antenna.

In accordance with one feature of the present invention, applicant greatly minimizes the radiation of signals from the outer conductor 44 of the coaxial cable, by the use of a balancing tab 90. The balancing tab is in the form of an electrical conductor that extends from one side of the boom and that lies a small distance from the loop 54 of the electrical coupling. The balancing tab has a lateral length D (FIG. 4) that is less than the average length of the directors 28 and less than the average length of projection of a director from the boom, and lies forward of the front loop part 60. The separation distance A (FIG. 5) between them is of the same order of magnitude as the separation of the loop 54 and Yagi structure 12, and the tab lies rearward of the first director 32.

Applicant found that the effects of unwanted transmission radiation in a Yagi antenna could be suppressed by a tab when applicant accidently touched the boom of a Yagi antenna with a screwdriver while monitoring the performance of the antenna, and found that the performance was improved. Further experimentation showed that the tab preferably has the shape, position and size shown in the drawings. The tab is most easily added by constructing the Yagi structure of a plate of metal with the tab being part of the plate. The tab 90 extends from the same side 22 of the boom as the side 72 of the loop gap where the outer conductor of the coaxial cable is connected, for coupling between the loop and balancing tab. The tab functions by inducing currents in the outer conductor (shield) of the coaxial cable, that cancel the undesirable shield currents caused by an unbalanced cable being connected to the balanced antenna. Applicant prefers to not have a tab extend from the opposite side 20 of the Yagi structure, although a much different length tab could extend there with optimal performance achieved by changing the spacing between the different length tab and the coupling assembly 50.

The Yagi antenna is constructed by first forming the Yagi structure 12 (including the balancing tab) of a metal plate such as of aluminum. The screw holes 84 are drilled in the mounting ears 80. 82. The folded dipole loop 54 is placed in the dielectric housing 72 and the conductors of a coaxial cable are soldered in place. The combination of loop and housing is placed facewise against one face of the Yagi structure, with the holes in the housing aligned with holes in the mounting ears. A pairs of screw fasteners 86 are projected through the ears and dielectric spacer portion and threaded into threaded holes 94 in the loop. A cover 100 of the housing is then closed. A small covering 102 lies over the screw heads.

Applicant has constructed and successfully tested the antenna shown in the figures, which was designed for transmissions in the 1900 MHz cell phone band. The antenna had a boom length of 330 millimeters, as measured from the rear of the reflector 30 to the front end of the boom, and a boom width B of 6 mm. Although the lateral length of the directors varies slightly, their length E is about 64 mm, their longitudinal dimensions C are about 6 mm, and they project about 29 mm from each side of the boom. The balancing tab 90 had the same longitudinal length C as the directors, and projected a distance D of 12 mm from one side of the boom. This projection distance D is less than half of an average lateral length E of the directors, is less than the lateral projection G of the directors from the boom, and is preferably no more than half the director projection G. The Yagi structure was formed of a plate of aluminum having a thickness of 2 mm to provide sufficient strength. The distance A between the balancing tab and the conductive loop was 3 mm, and is preferably no more than one centimeter.

Figure 6:
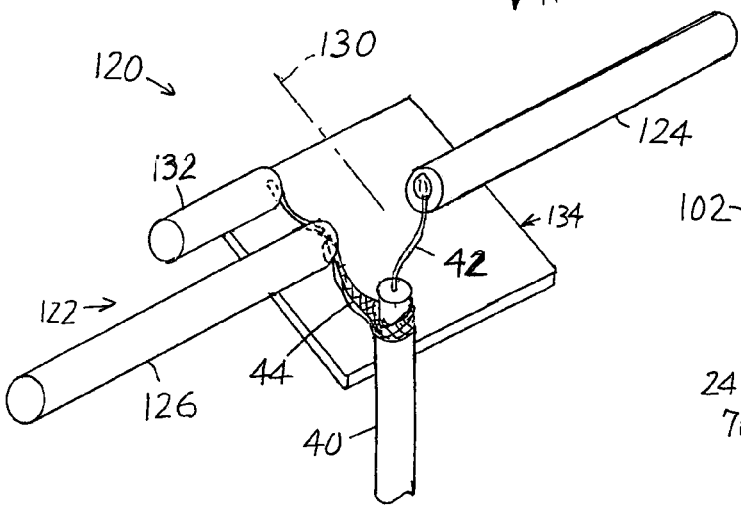
FIG. 6 is an isometric view of another antenna of the invention.

FIG. 6 illustrates a greatly simplified and inefficient balanced antenna 120 which includes a balanced structure in the form of a dipole structure 122 connected to a transmission line in the form of a coaxial cable 40. This antenna will radiate, although far less efficiently than if a Yagi structure were coupled to it as in FIGS. 1-5. The dipole structure includes two conductive dipole parts 124, 126 that extend in opposite radial directions from the antenna axis 130. The cable inner coax conductor 42 is connected to the radially inner end of the first dipole part 124. The cable outer coax conductor 44 is connected to the radially inner end of the second dipole part 126. The parts are shown mounted on an insulative board 134.

The dipole structure radiates energy, but the radiated energy is degraded by emissions from the cable outer conductor 44. Applicant counters such emissions from the cable outer conductor by providing a balancing tab 132 that is elongated and that extends parallel and adjacent to the second dipole part 126. Applicant notes that the dipole parts 124, 126 correspond to opposite sides 62A, 62B of the rear loop part of the folded dipole of FIG. 4.

Thus, the invention provides an antenna, and especially a Yagi antenna, which minimizes radiation from a portion of the connected transmission line such as the outer conductor of a coaxial cable. Such radiation is suppressed by a balancing tab. The balancing tab lies forward of a dipole or electrical coupling loop and in the case of a Yagi projects from a side of the Yagi boom that is closest to the outer conductor of the coaxial cable. The coaxial cable is coupled to the Yagi structure by a folded dipole in the form of a conductive loop that is elongated in a lateral direction, and which can be made of a metal plate. The coaxial conductors of the coax cable are connected to opposite sides of a rear loop part, at opposite sides of a gap therein. The loop is mechanically connected to the Yagi structure with the plane of the metal plate of the loop lying parallel to a face of the Yagi structure plate, and with a dielectric spacer of a housing lying between them.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. An antenna comprising a balanced antenna structure which has an axis and includes a dipole with first and second conductive elongated dipole parts that extend in opposite radial directions from said axis and that are elongated in said radial directions, and a coaxial cable that has a coax center conductor connected to an inner end of a first of said dipole parts and that has a coax outer conductor connected to an inner end of the second of said dipole parts, including:

a balancing tab that is elongated in a direction radial to said axis, said balancing tab being electrically coupled to said inner end of said second dipole part, said balancing tab being shorter than said second dipole part and extending parallel to and adjacent to said second dipole part to inductively and capacitively couple them.

2. The antenna described in claim 1 wherein:

said first and second dipole parts form ends of a folded dipole;

said antenna also includes a Yagi structure that is capacitively and inductively coupled to said folded dipole, said Yagi structure having a reflector and a plurality of directors, said balancing tab forming a part of said Yagi structure.

3. An antenna which includes an electrically conductive Yagi structure having a boom that is elongated in front and rear longitudinal directions, the boom having laterally spaced opposite sides and having first and second opposite faces, the Yagi structure having a reflector and a plurality of directors that each extends to laterally opposite sides of the boom and that is each laterally elongated, with the reflector and directors being spaced apart along the length of said boom, the antenna having an electrical coupling located at a rear portion of the boom for coupling the Yagi structure to a coaxial cable that has a cable center conductor and a cable outer conductor, wherein:

said electrical coupling comprises a folded dipole in the form of a loop conductor that extends in a loop that lies adjacent to said Yagi structure and that has a loop gap, the center and outer cable conductors of the coaxial cable being connected to the loop conductor respectively at first and second opposite sides of said loop gap;

said Yagi structure has a conductive balancing tab that projects from said boom to one side of said boom, that has a lateral length less than half of an average lateral length of said directors, and that lies adjacent to said loop conductor.

4. The antenna described in claim 3 wherein:

said Yagi structure include a reflector at the rear portion of the boom and a first director spaced forward of said reflector;

said loop conductor has front and rear loop parts and at least one of said loop parts of said loop conductor lies between said reflector and said first director, and said balancing tab lies forward of said loop conductor and rearward of said first director.

5. The antenna described in claim 3 wherein:

said Yagi structure is formed of a sheet of conductive material having said opposite faces;

said loop conductor is elongated in said lateral direction and has front and rear loop parts, said rear loop part lying rearward of said front loop part and rearward of said balancing tab and forming said gap.

6. The antenna described in claim 5 wherein:

said loop conductor is formed of a plate of metal having opposite plate faces facing in the same directions as said boom first and second opposite faces, with said plate of metal spaced from an adjacent one of said Yagi structure faces by no more than an average longitudinal width of said directors.

7. The antenna described in claim 3 including a reflector lying at a rear portion of the boom and rearward of said directors, and wherein:

said Yagi structure has at least one mounting ear projecting laterally from at least one side of said boom at a location between said balancing tab and said reflector, said ear projecting laterally from said boom by less than half the length of lateral projection of said reflector from said first side of said boom;

said antenna includes a dielectric spacer lying between said loop and said mounting ear and having at least one hole, and including at least one metal fastener that extends through said at least one hole in said dielectric spacer and that is fixed to said boom and to said loop.

8. An antenna which includes an electrically conductive plate which forms a Yagi structure having a boom portion that has top and bottom faces and that is longitudinally elongated in front and rear directions, the Yagi structure also having a plurality of directors and a reflector that each projects in laterally opposite directions from laterally opposite sides of the boom portion, said reflector lying rearward of said directors and said directors include a first director spaced forward of said reflector, said Yagi structure forming a mount region lying between said reflector and said first director, the antenna also including an electrical coupling for coupling the Yagi structure to a coaxial cable having center and outer coax conductors, wherein:

said electrical coupling comprises a folded dipole mounted on said Yagi structure, said folded dipole comprising an electrically conductive dipole plate having top and bottom surface and having plate portions extending in a loop that has laterally-elongated front and rear loop parts that are longitudinally spaced and that has a pair of laterally opposite loop sides that each connects a pair of ends of said loop parts, with said rear loop part having a gap, said coaxial cable center and outer coaxial conductors each connected to said rear loop part at a different side of said loop gap;

said dipole plate lies facewise adjacent to but spaced from said Yagi structure.

9. The antenna described in claim 8 wherein:

said Yagi structure has a conductive balancing tab that is shorter in lateral length than either side of said first director and that extends laterally from one side of said boom at a boom location that lies in said mount region.

10. The antenna described in claim 9, wherein:

said balancing tab lies forward of said reflector but rearward of said first director, and lies forward of said front loop part.

11. The antenna described in claim 8 wherein:

said Yagi structure has a pair of mounting ears lying in said mount region and projecting from laterally opposite sides of said boom portion;

said dipole plate of said electrical coupling is mounted on said Yagi structure by a plurality of fasteners that fasten said dipole plate to said mounting ears, said antenna including a dielectric member lying between said dielectric plate and said Yagi structure.

12. A method for electrically coupling a coaxial cable that has inner and outer coax conductors, to a Yagi structure that includes an elongated boom having laterally opposite sides and top and bottom faces and front and rear ends and a plurality of directors and a reflector extending laterally from said opposite sides of said boom, said reflector and a first of said directors defining a mount region between them, including:

mounting a folded dipole formed of a conductive dipole plate that extends in an elongated loop that has long front and rear loop parts and shorter loop sides and with a gap in one of said loop parts, on said Yagi element in said mount region with the length of said loop extending laterally, so a face of the dipole plate is parallel to one of said boom faces, and with a dielectric separator between them;

connecting said inner and outer coax conductors to locations on said loop that lie at opposite sides of said gap.

13. The method described in claim 12 wherein:

forming said Yagi structure with a tab having a lateral length less than half the lateral length of said first director so the tab extends laterally from one side of said boom in said rear mount region, and said step of mounting a folded dipole includes positioning said front loop part in said rear mount region at a location adjacent to said tab, to thereby reduce radiation from the outer coax conductor.

* * * * *